US006069308A

United States Patent [19]

Rabb

[11] Patent Number: 6,069,308

[45] Date of Patent: May 30, 2000

[54] RHYTHM SAW

[75] Inventor: John Rabb, Antioch, Tenn.

[73] Assignee: H.B.R. Innovations, Inc., Toone, Tenn.

[21] Appl. No.: 09/326,963

[22] Filed: Jun. 7, 1999

[51] Int. Cl.[7] ..... G10D 13/02

[52] U.S. Cl. ..... 84/422.4; 84/402; 84/403; 446/397

[58] Field of Search ..... 84/422.4, 402, 84/403, 404, 102; 446/417, 418, 397, 404, 80

[56] References Cited

U.S. PATENT DOCUMENTS

| | | | |
|---|---|---|---|
| D. 278,634 | 4/1985 | Anderson . | |
| D. 295,872 | 5/1988 | Koumarianos . | |
| 1,484,777 | 2/1924 | Hassenpflug . | |
| 1,495,672 | 5/1924 | Cheney | 84/411 R |
| 3,608,419 | 9/1971 | Russell . | |
| 4,476,768 | 10/1984 | Willis . | |
| 4,488,470 | 12/1984 | Larrain . | |
| 4,719,836 | 1/1988 | Baumgart . | |
| 5,370,030 | 12/1994 | Horne . | |

*Primary Examiner*—Robert E. Nappi
*Assistant Examiner*—Shih-yung Hsieh
*Attorney, Agent, or Firm*—Luedeka, Neely & Graham, P.C.

[57] ABSTRACT

A new musical instrument and method for playing the same is described. The invention adds to the design of the conventional drumstick a series of ridges that produce a new and unique sound when the ridges are dragged across another object. This object might be another drumstick, a drum rim, highhat or any other object. The invention includes a handle portion, a playing tip and a saw portion which is located between the handle portion and the playing tip. Alternating peaks and grooves form a series of ridges along the saw portion of the drumstick. The saw portion is dragged across another object to create a rasping sound.

30 Claims, 9 Drawing Sheets

RHYTHM SAW

TECHNICAL FIELD

The present invention relates generally to musical instruments. More particularly, the present invention relates to a percussion instrument which combines a drumstick with a new instrument for producing a rasping sound and a method for playing this instrument.

BACKGROUND

It will be appreciated that there currently exists numerous variations on the design of a drumstick as well as various methods of playing drumsticks. Some design variations for drumsticks are directed to the playing tip of the stick, to change the sound produced by the drumstick when it strikes the surface of a drum, while other design variations are intended to provide a more secure grip and better control of the drumstick or to make the drumstick more comfortable to use.

Examples of drumsticks which have been modified to provide improved gripping can be found in U.S. Pat. No. 4,488,470; U.S. Pat. No. 1,484,777; U.S. Pat. No. 3,608,419; U.S. Pat. No. 4,476,768; U.S. Pat. No. 4,719,836; U.S. Pat. No. 5,370,030; and U.S. Pat. No. D295,782. These patents offer improved gripping methods by altering the handle portion of a drumstick in various manners. The invention of U.S. Pat. No. 4,488,470 shows a drumstick having square cut grooves along the handle for gripping purposes. U.S. Pat. No. 1,484,777 teaches a drumstick with string or cord wrapped around the handle and U.S. Pat. No. 3,608,419 teaches a drumstick with a handle grip of nylon fibers. None of these patents suggest a new way of playing a drumstick.

What is needed, then, is a musical instrument which can be played as a conventional drumstick and can also be played in a new manner to produce a unique sound. Such an instrument is presently lacking in the prior art.

SUMMARY

With regard to the foregoing and other objects, the invention in one aspect provides a new musical instrument and method for playing the same. The present invention adds to the design of a drumstick a series of ridges which are used to produce new and unique sounds when the ridges are dragged across another object. This object might be another drumstick, a drum rim, cymbals or any other object.

The ridges are formed along the forward half of the drumstick and are composed of a series of alternating peaks and grooves. The peaks and grooves are integral to the drumstick and are rounded in shape to allow the drumstick to slide smoothly across the other object without catching. In addition to being rounded, the grooves should be within a depth range that prevents the grooves from being so deep that the drumstick will not move smoothly across another surface or that the structural integrity of the drumstick is compromised. The drumstick should also be proportional so that the forward end is not top heavy and the length of the parts of the handle should also be proportional.

The number and spacing of the ridges affects the type of sound produced. Although any number of ridges are contemplated and could be used, a preferred embodiment of the present invention would include either 10 or 14 ridges.

The present invention may therefore be summarized in a variety of ways, one of which is the following: a drumstick which comprises a handle portion, a playing tip and a saw portion located between and connecting the handle portion and the playing tip. The drumstick wherein the length of the handle portion is greater than the length of the saw portion and the length of the saw portion is greater than the length of the playing tip. The drumstick wherein the handle portion is smooth. The drumstick wherein the playing tip is formed to be utilized to play drums and other percussion instruments. The drumstick wherein the saw portion includes a series of ridges. The drumstick wherein the ridges are integral with the drumstick. The drumstick wherein the ridges are formed by a series of alternating peaks and grooves. The drumstick wherein the diameter of the handle portion is less than the diameter of the peaks. The drumstick wherein the diameter of the playing tip tapers from the diameter of the peaks. The drumstick wherein the peaks are convex curves. The drumstick wherein the grooves are concave curves. The drumstick wherein the peaks have a radius of curvature in the range of about 0.07 to 0.14 inches. The drumstick wherein the peaks have a radius of curvature in the range of about 0.09 to 0.10 inches. The drumstick wherein the grooves have a radius of curvature in the range of about 0.10 to 0.14 inches. The drumstick wherein the grooves have a radius of curvature of about 0.14 inches. The drumstick wherein the pitch between the peaks is in the range of about 0.35 inches to 0.43 inches. The drumstick wherein the pitch between the peaks is in the range of about 0.37 to 0.38 inches. The drumstick wherein the depth of the grooves is in the range of about 0.04 inches to 0.13 inches. The drumstick wherein the depth of the grooves is in the range of about 0.075 to 0.080 inches.

Yet another way of summarizing the invention is: a percussion instrument which comprises an elongated cylindrical member having a forward end and a rear end, the rear end forming a handle by which the instrument may be grasped, and the forward end further including a saw and a playing tip, wherein the playing tip is formed to be utilized to play drums and other percussion instruments and the saw includes a series of ridges which can be dragged across an object to create a rasping sound. The percussion instrument wherein the length of the handle is greater than the length of the saw and the length of the saw is greater than the length of the playing tip. The percussion instrument wherein the handle is smooth. The percussion instrument wherein the ridges are integral with the cylindrical member. The percussion instrument wherein the ridges are formed by a series of alternating peaks and grooves. The percussion instrument wherein the peaks have a radius of curvature in the range of about 0.07 to 0.14 inches. The percussion instrument wherein the grooves have a radius of curvature in the range of about 0.10 to 0.14 inches. The percussion instrument wherein the pitch between the peaks is in the range of about 0.35 inches to 0.43 inches. The percussion instrument wherein the depth of the grooves is in the range of about 0.075 to 0.080 inches.

A third way of summarizing the invention is a percussion instrument which comprises a wooden stick having a handle portion, a saw portion and a playing tip, wherein the handle portion is longer than the saw portion, the saw portion includes a series of ridges integral to the stick and the outside diameter of the ridges is greater than the outside diameter of the handle portion.

A way of summarizing the method of the present invention is: a method for playing a percussion instrument, comprising providing a percussion instrument including a drumstick having a handle portion, a playing tip and a saw portion located between and connecting the handle portion and the playing tip, and a series of ridges on the saw portion, grasping the drumstick by the handle portion and dragging the saw portion across an object to create a rasping sound.

BRIEF DESCRIPTION OF THE DRAWINGS

The above and other features, aspects and advantages of the present invention will now be discussed in the following detailed description and appended claims considered in conjunction with the accompanying drawings in which:

DETAILED DESCRIPTION OF A PREFERRED EMBODIMENT

Figure 1:
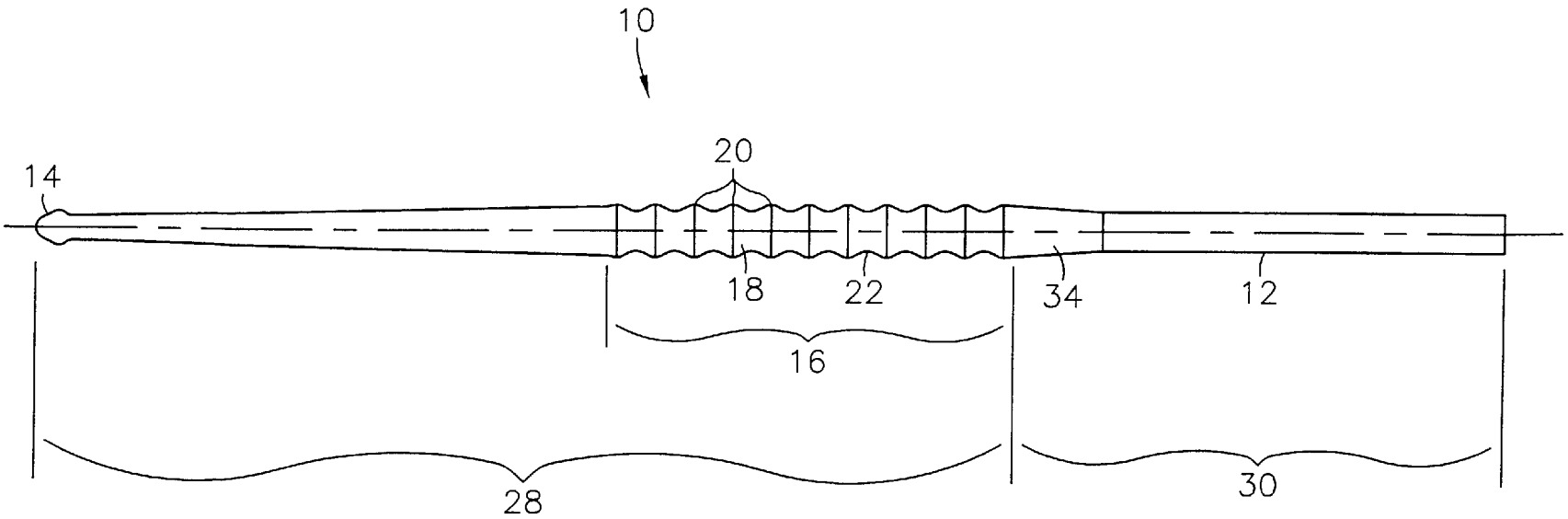
FIG. 1 is a side view of a rhythm saw according to the present invention.

With reference now to the drawings in which like reference characters designate like or similar parts throughout the several views, the drumstick of this invention is referred to generally as 10. The drumstick 10 is a substantially cylindrical member having a forward end 28 and a rear end 30. The drumstick 10 may be constructed of wood or any other suitable material. The drumstick 10 has a handle portion 12, a playing tip 14 and a saw portion 16 which is located between the handle portion 12 and the playing tip 14. The playing tip 14 and the saw portion 16 are located adjacent the forward end 28 of the drumstick 10 while the handle portion 12 is located adjacent the rear end 30.

Figure 3:
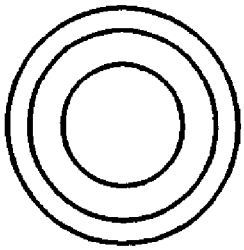
FIG. 3 is a back view of the rhythm saw of FIG. 1.
Figure 2:
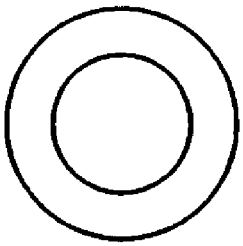
FIG. 2 is a is a front view of the rhythm saw of FIG. 1.
Figure 4:
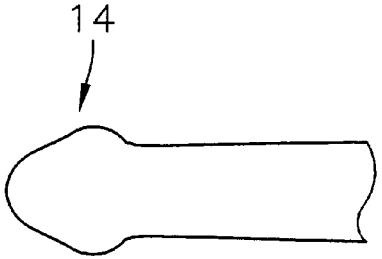
FIG. 4 is an enlarged sectional view of a rhythm saw playing tip according to the invention.

FIG. 2 and FIG. 3 show a front end view and a back end view of one embodiment, respectively. A sectional view of the playing tip 14 is shown in FIG. 4.

Figure 7:
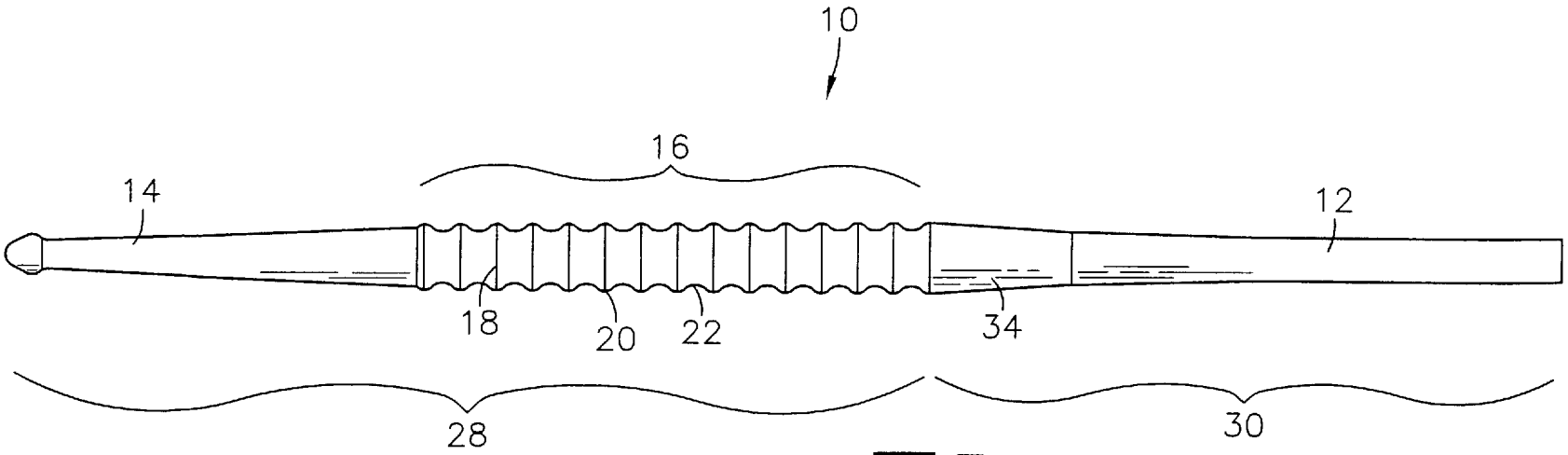
FIG. 7 is a side view of an alternate embodiment of a rhythm saw according to the present invention.

With reference to FIG. 1 and FIG. 7, the length of the handle portion 12 is preferably greater than the length of the saw portion 16. In the embodiment illustrated in FIG. 7, the length of the saw portion 16 is greater than the length of the playing tip 14. The handle portion 12 is smooth in relation to the saw portion 16. The playing tip 14 is constructed to be hit against drums and other percussion instruments.

Figure 5:
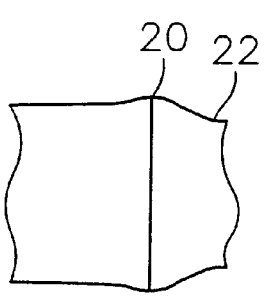
FIG. 5 is an enlarged sectional view of a rhythm saw peak according to the present invention.

The saw portion 16 includes a series of ridges 18 which can be moved across another object to create a rasping sound. There may be any number of ridges 18 but the preferred embodiments of the invention have 10 and 14 ridges, as shown in FIG. 1 and FIG. 7, respectively. Preferably, the ridges 18 are formed as an integral part of the drumstick 10. Ridges 18 are formed by a series of alternating peaks 20 and grooves 22, as shown in FIGS. 1, 5 and 7. In a preferred embodiment, the diameter of the handle portion 12 is less than the diameter of the peaks 20. Handle portion 12 preferably includes a tapered portion 34 adjacent to the saw portion 16. As shown in FIG. 7, the diameter of the playing tip 14 tapers from the diameter of the peaks 20.

Figure 6:
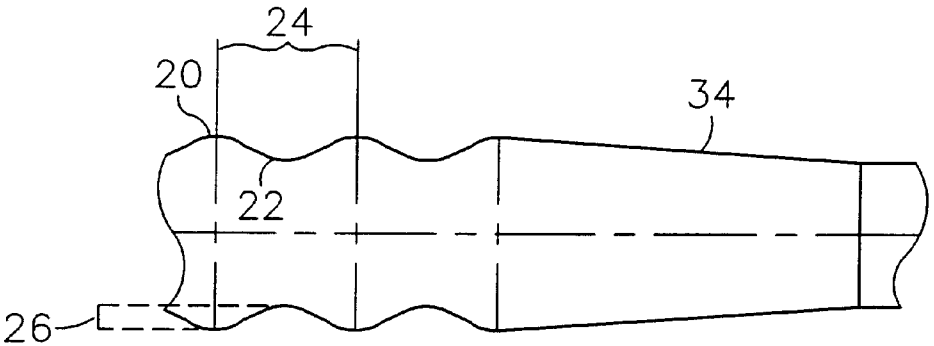
FIG. 6 is an enlarged sectional view of the taper portion of a rhythm saw according to the present invention.

With reference to FIG. 6, the peaks 20 are convex curves and the grooves 22 are concave curves. In one embodiment of the present invention, peaks 20 have a radius of curvature in the range of about 0.07 to 0.14 inches. In another embodiment of the invention, peaks 20 have a radius of curvature in the range of about 0.09 to 0.10 inches.

In one embodiment of the present invention, grooves 22 have a radius of curvature in the range of about 0.10 to 0.14 inches. In another embodiment of the invention, grooves 22 have a radius of curvature of about 0.14 inches.

The distance between peaks 20 is pitch 24. In one embodiment of the invention, the pitch 24 is in the range of about 0.35 to 0.43 inches. Another embodiment has a pitch 24 in the range of about 0.37 to 0.43 inches.

The depth 26 of the grooves 22 is in the range of about 0.04 to 0.13 inches in one embodiment and in another embodiment, the depth 26 is in the range of about 0.075 to 0.080 inches.

FIGS. 8 through 19 show various alternate embodiments of the present invention. Although these embodiments are not the preferred version, each embodiment is capable of being used as a Rhythm Saw in the method described herein. Additionally, these figures provide illustrations of different, conventional playing tips for drumsticks that may be used interchangeably on the drumsticks of the preferred embodiments.

Figure 8:
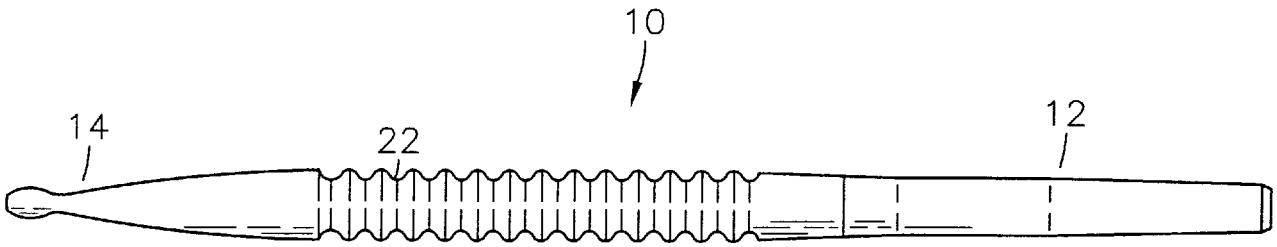
FIG. 8 is a side view of an alternate embodiment of a rhythm saw according to the present invention.

FIG. 8 shows an embodiment wherein the grooves 22 are deeper, creating a different sound quality. This drumstick 10 does not move across another object as smoothly as the drumsticks of the preferred embodiments.

Figure 9:
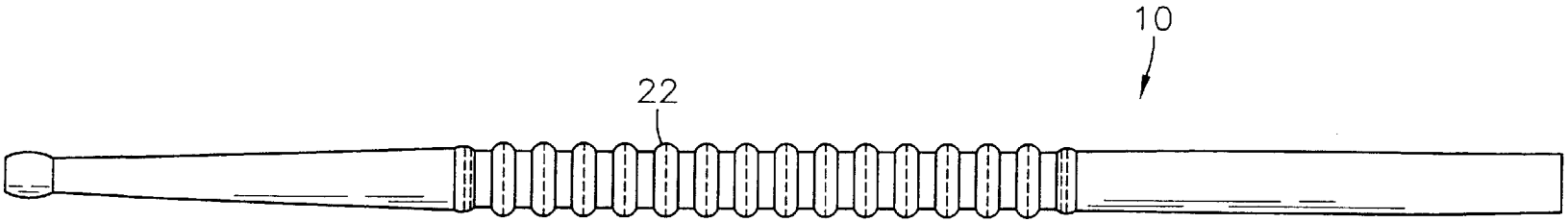
FIG. 9 is a side view of an alternate embodiment of a rhythm saw according to the present invention.

The drumstick 10 illustrated in FIG. 9 has relatively flat grooves 22 as compared to the concave curves of the preferred embodiment. Grooves 22 are also spaced farther apart than the grooves of the preferred embodiment.

Figure 10:
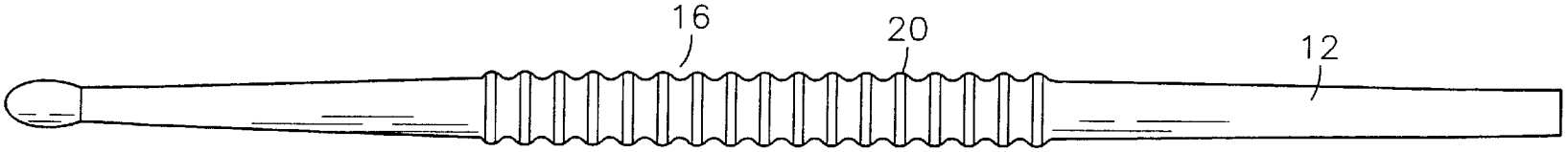
FIG. 10 is a side view of an alternate embodiment of a rhythm saw according to the present invention.

In the embodiment shown in FIG. 10, the handle 12 does not taper away from the saw portion 16. Additionally, the peaks 20 are flat as opposed to the convex curves of the preferred embodiments.

Figure 11:
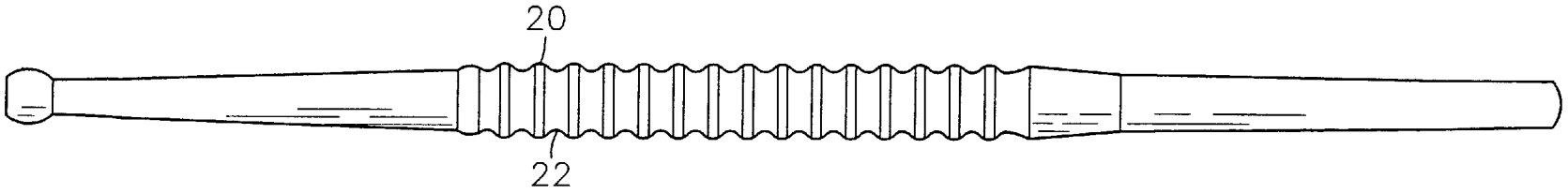
FIG. 11 is a side view of an alternate embodiment of a rhythm saw according to the present invention.
Figure 12:
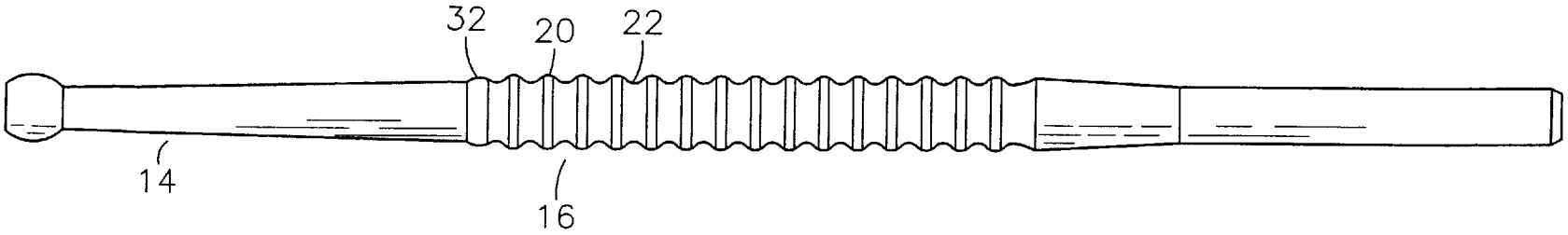
FIG. 12 is a side view of an alternate embodiment of a rhythm saw according to the present invention.

FIG. 11 shows an embodiment with flatter peaks 20 and wider grooves 22. FIG. 12 shows a similar embodiment incorporating flatter peaks 20 and wider grooves 22, but also incorporating an extra wide peak 32 connecting the saw portion 16 to the playing tip 14.

Figure 13:
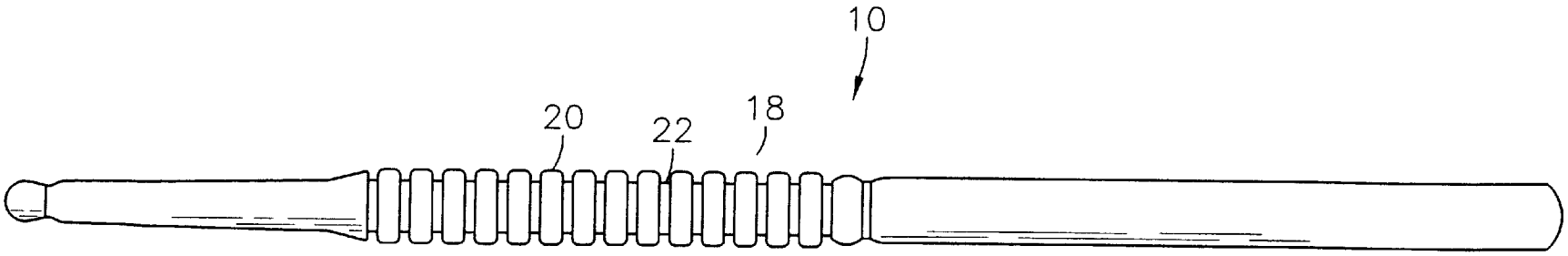
FIG. 13 is a side view of an alternate embodiment of a rhythm saw according to the present invention.
Figure 14:
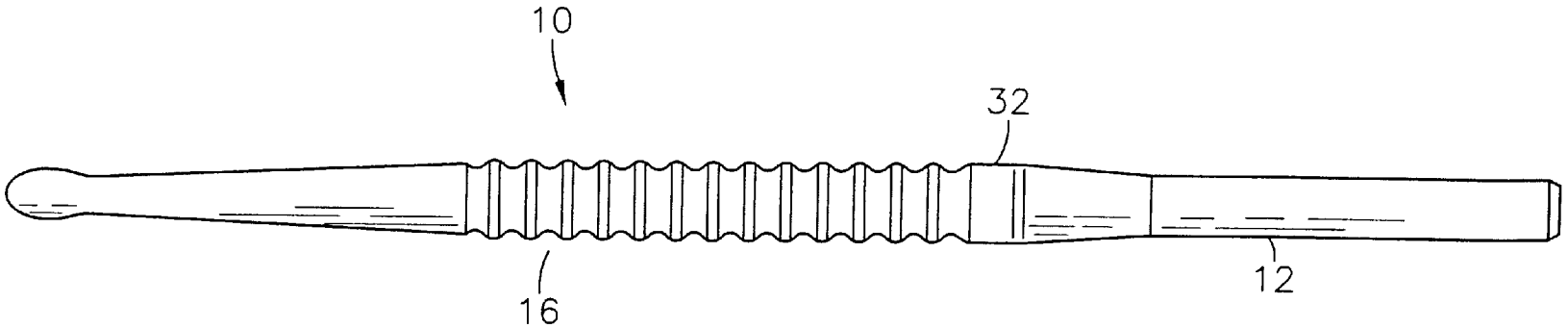
FIG. 14 is a side view of an alternate embodiment of a rhythm saw according to the present invention.
Figure 15:
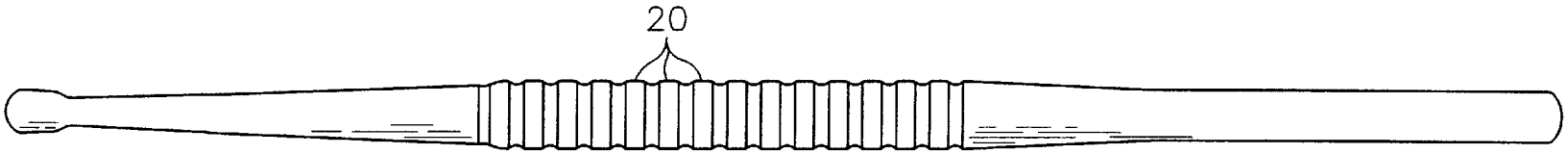
FIG. 15 is a side view of an alternate embodiment of a rhythm saw according to the present invention.
Figure 18:
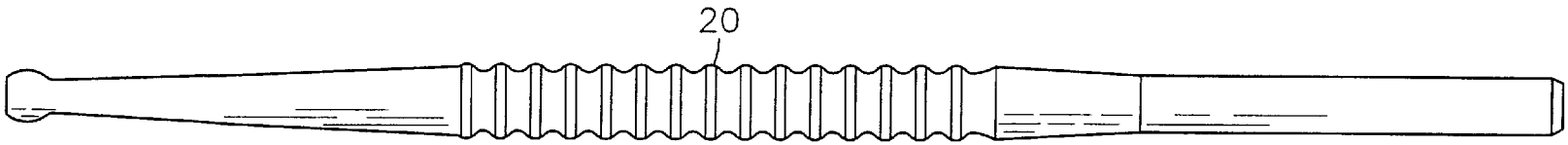
FIG. 18 is a side view of an alternate embodiment of a rhythm saw according to the present invention.

The drumstick 10 of FIG. 13 has flat grooves 22, peaks 20 that are flat with rounded comers and a non-uniform series of ridges 18. FIG. 14 illustrates a drumstick 10 with an extra wide peak 32 connecting the saw portion 16 and the handle portion 12. FIG. 15 and FIG. 18 show other embodiments using flat peaks 20.

Figure 16:
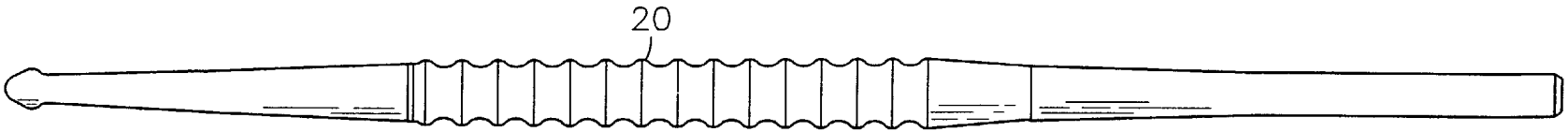
FIG. 16 is a side view of an alternate embodiment of a rhythm saw according to the present invention.
Figure 17:
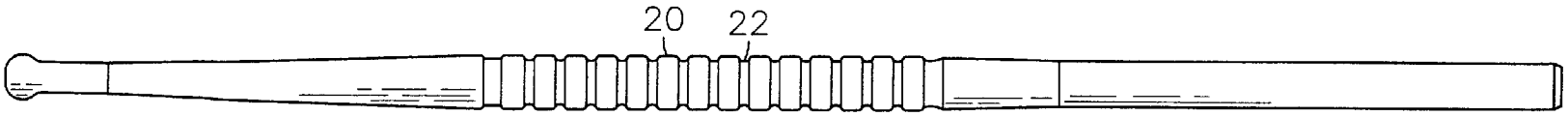
FIG. 17 is a side view of an alternate embodiment of a rhythm saw according to the present invention.
Figure 19:
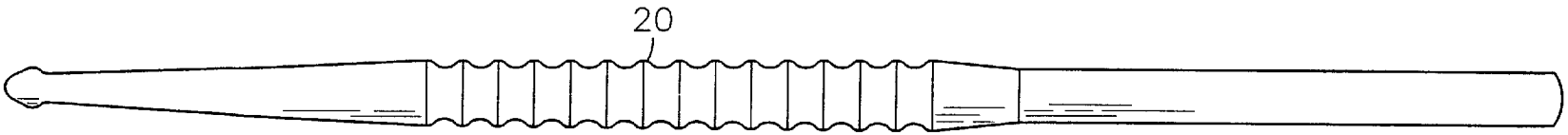
FIG. 19 is a side view of an alternate embodiment of a rhythm saw according to the present invention.

The embodiments shown in FIG. 16 and FIG. 19 utilize peaks 20 that are more sharply pointed than the rounded peaks of the preferred embodiments. FIG. 17 shows an embodiment with flatter peaks 20 which are significantly wider than the flat grooves 22.

METHOD FOR PLAYING A PERCUSSION INSTRUMENT

The method of the present invention involves constructing a percussion instrument having a handle portion 12, a saw portion 16 and a playing tip 14, where the saw portion 16 is located between the handle portion 12 and the playing tip 14. The saw portion 16 has a series of ridges 18. The method also includes grasping the drumstick 10 by the handle portion 12 and dragging the saw portion 16 across an object to create a rasping sound. A variety of rasping sounds can be made by dragging the saw portion 16 across different objects and/or at different speeds. Objects that could be used in this method include, but are not limited to, the rim of a drum, cymbals, highhat, another rhythm saw, cow bell, a conventional drumstick and a wood block.

It is contemplated, and will be apparent to those skilled in the art from the foregoing specification, drawings, and examples that modifications and/or changes may be made in the embodiments of the invention. Accordingly, it is expressly intended that the foregoing are only illustrative of preferred embodiments and modes of operation, not limiting thereto, and that the true spirit and scope of the present invention be determined by reference to the appended claims.

What is claimed is:

1. A drumstick which comprises:

(a) a handle portion;

(b) a playing tip; and (c) a saw portion located between and connecting said handle portion and said playing tip.

2. The drumstick of claim 1, wherein the length of said handle portion is greater than the length of said saw portion and the length of said saw portion is greater than the length of said playing tip.

3. The drumstick of claim 1, wherein said handle portion is smooth.

4. The drumstick of claim 1, wherein said playing tip is formed to be utilized to play drums and other percussion instruments.

5. The drumstick of claim 1, wherein said saw portion includes a series of ridges.

6. The drumstick of claim 1, wherein said ridges are integral with the drumstick.

7. The drumstick of claim 6, wherein said ridges are formed by a series of alternating peaks and grooves.

8. The drumstick of claim 7, wherein the diameter of said handle portion is less than the diameter of said peaks.

9. The drumstick of claim 7, wherein the diameter of said playing tip tapers from the diameter of said peaks.

10. The drumstick of claim 7, wherein said peaks are convex curves.

11. The drumstick of claim 7, wherein said grooves are concave curves.

12. The drumstick of claim 7, wherein said peaks have a radius of curvature in the range of about 0.07 to 0.14 inches.

13. The drumstick of claim 7, wherein said peaks have a radius of curvature in the range of about 0.09 to 0.10 inches.

14. The drumstick of claim 7, wherein said grooves have a radius of curvature in the range of about 0.10 to 0.14 inches.

15. The drumstick of claim 7, wherein said grooves have a radius of curvature of about 0.14 inches.

16. The drumstick of claim 7, wherein the pitch between said peaks is in the range of about 0.35 inches to 0.43 inches.

17. The drumstick of claim 7, wherein the pitch between said peaks is in the range of about 0.37 to 0.38 inches.

18. The drumstick of claim 7, wherein the depth of said grooves is in the range of about 0.04 to 0.13 inches.

19. The drumstick of claim 7, wherein the depth of said grooves is in the range of about 0.075 to 0.080 inches.

20. A percussion instrument which comprises:

(a) an elongated cylindrical member having a forward end and a rear end;

(b) said rear end forming a handle by which the instrument may be grasped; and (c) said forward end further including a saw and a playing tip, wherein said playing tip is formed to be utilized to play drums and other percussion instruments and said saw includes a series of ridges which can be dragged across an object to create a rasping sound.

21. The percussion instrument of claim 20, wherein the length of said handle is greater than the length of said saw and the length of said saw is greater than the length of said playing tip.

22. The percussion instrument of claim 20, wherein said handle is smooth.

23. The percussion instrument of claim 20, wherein said ridges are integral with said cylindrical member.

24. The percussion instrument of claim 20, wherein said ridges are formed by a series of alternating peaks and grooves.

25. The percussion instrument of claim 24, wherein said peaks have a radius of curvature in the range of about 0.07 to 0.14 inches.

26. The percussion instrument of claim 24, wherein said grooves have a radius of curvature in the range of about 0.10 to 0.14 inches.

27. The percussion instrument of claim 24, wherein the pitch between said peaks is in the range of about 0.35 inches to 0.43 inches.

28. The percussion instrument of claim 24, wherein the depth of said grooves is in the range of about 0.075 to 0.080 inches.

29. A percussion instrument which comprises:

a wooden stick having a handle portion, a saw portion and a playing tip;

wherein said handle portion is longer than said saw portion, said saw portion including a series of ridges integral to said stick and the outside diameter of said ridges being greater than the outside diameter of said handle portion.

30. A method for playing a percussion instrument, comprising:

(a) providing a percussion instrument including a drumstick having a handle portion, a playing tip and a saw portion located between and connecting said handle portion and said playing tip, and a series of ridges on said saw portion;

(b) grasping said drumstick by said handle portion; and (c) dragging said saw portion across an object to create a rasping sound.

* * * * *